US005418510A

United States Patent [19]

Gray

[11] Patent Number: 5,418,510

[45] Date of Patent: May 23, 1995

[54] CYLINDRICAL WAVEGUIDE RESONATOR FILTER SECTION HAVING INCREASED BANDWIDTH

[75] Inventor: Devon J. Gray, Torrance, Calif.

[73] Assignee: Hughes Aircraft Company, Los Angeles, Calif.

[21] Appl. No.: 156,116

[22] Filed: Nov. 22, 1993

[51] Int. Cl.[6] ..... H01P 1/208; H01P 7/06

[52] U.S. Cl. ..... 333/208; 333/212; 333/230

[58] Field of Search ..... 333/202, 208–212, 333/227–233, 21 R, 21 A

[56] References Cited

U.S. PATENT DOCUMENTS

| | | | |
|---|---|---|---|
| 2,810,890 | 10/1957 | Klopfenstein | 333/211 |
| 3,758,882 | 9/1973 | Mörz | 333/21 A |
| 4,513,264 | 4/1985 | Dorey et al. | 333/209 X |
| 4,721,933 | 1/1988 | Schwartz et al. | 333/209 X |
| 4,777,459 | 10/1988 | Hudspeth | 333/212 X |
| 5,012,211 | 4/1991 | Young et al. | 333/209 X |

FOREIGN PATENT DOCUMENTS

| | | | |
|---|---|---|---|
| 0014501 | 1/1985 | Japan | 333/21 A |

*Primary Examiner*—Seungsook Ham

*Attorney, Agent, or Firm*—Terje Gudmestad; W. K. Denson-Low

[57] ABSTRACT

A high Q microwave filter is disclosed. Coupling bar structures are included in a cylindrical resonator, extending substantially the entire length of the resonator for coupling orthogonal modes. The coupling bars have a lower profile than conventional tuning screws. The symmetry of the filter structure is improved over the prior art coupling devices which relied entirely on tuning screws for coupling E fields of one mode to the other mode. The coupling bar structure has a lower profile penetrating less into the supported E fields while obtaining the desired coupling. Increased bandwidth may be obtained at improved symmetries over the prior art devices. Fine tuning may be provided by inserting tuning screws into the cylindrical cavity. The tuning screws require less penetration as substantially most of the coupling occurs by virtue of the coupling bars.

16 Claims, 3 Drawing Sheets

1. X = RESONANT REACTANCE
   ($X_S$ = SCREW REACTANCE)($X_B$ = BAR REACTANCE)
2. $L_S$ = SCREW LENGTH
3. $H_B$ = COUPLING BAR HEIGHT
4. $f_o$ = OPERATING FILTER PASSBAND
5. $f_S = \frac{11.800}{4\ L_S}$
6. $f_B = \frac{11.800}{4\ H_B}$

CYLINDRICAL WAVEGUIDE RESONATOR FILTER SECTION HAVING INCREASED BANDWIDTH

The present invention relates to the microwave communications field. Specifically, a cylindrical waveguide resonator is described having increased bandwidth and minimal asymmetry.

In direct broadcast microwave systems, such as DBS and BSD, final frequency filtering is necessary at the KU band. These systems are extremely sensitive to signal losses which occur in the filtering sections. In an attempt to increase the bandwidth in a microwave filter, the passband filter response can become asymmetric, further increasing the losses within the final signal filtering stage.

In the cylindrical waveguide resonator art, high Q filters are produced at the KU band operating in the TE113 electromagnetic propagation mode. In the past, these resonators have employed devices for coupling one orthogonal mode to the other orthogonal mode of a TE113 mode supported in a cylindrical waveguide resonator. By adjusting the amount of coupling between modes, it is possible to control the bandwidth for each filter section implemented in a cylindrical waveguide resonator.

A typical coupling device includes screws which are threaded into the sides of the cylindrical waveguide resonator at opposite positions along a common diameter of the waveguide resonator. The screws are located along the circumference of the waveguide so that they have an axis which is oriented 45° to each axis of the orthogonal modes of the electromagnetic field. As the depth of the screws into the waveguide increases the coupling between the two orthogonal modes increases.

The coupling achieved through this technique is limited due to the effect of the screws on the symmetry of each of the E fields of each orthogonal mode. As the screw depth becomes greater, the ultimate filter response becomes severely asymmetric.

The degradation in symmetry provides for an upper limit on the ability to achieve a practical filter bandwidth using the foregoing coupling technique. Additionally, the increased depth of the screws not only distorts field symmetry, but creates unwanted cross-couplings which may create other unwanted modes within the cylindrical resonator.

SUMMARY OF THE INVENTION

It is an object of this invention to provide for a microwave filter section having an increased bandwidth and minimal insertion loss.

It is a more specific object of this invention to provide a device which will couple orthogonal modes in a cylindrical cavity to produce a filter response having a low resonant reactance, and which produces minimal parasitic couplings to other modes, therefore maintaining a symmetrical shape.

These and other objects of the invention are provided by a dual mode cylindrical cavity which includes a device for coupling two orthogonal modes of electromagnetic radiation in the cylindrical cavity. The coupling devices include a pair of coupling bars which extend over the majority of the length of the cylindrical cavity. The coupling bars are on opposite sides of the cavity wall, lying along a common diagonal. The coupling bars are uniquely oriented to couple energy between first and second electromagnetic orthogonal modes within the filter. Fine-tuning by the use of coupling screws may also be included. The screws are inserted through the cylindrical cavity exterior wall surface and coupling bars, permitting the amount of coupling to be finely-tuned by adjusting the depth of penetration within the cylindrical cavity.

The filter response using the coupling bars is symmetric, and exhibits less resonant reactance than a prior art cylindrical resonant cavity which relies solely on tuning screws as the primary mode coupling mechanism. This aspect is very evident in the quasi-elliptic filter form. In this form, a bridge coupling produces a set of side lobes that become severely asymmetric when coupling screws are used.

In accordance with the preferred embodiment, a Chebyshev KU band filter structure can be obtained, having a bandwidth of 400 megacycles in a TE113 cylindrical cavity resonator. The filter structure has a pair of coupling bars having a thickness which provides for the requisite coupling and corresponding fractional bandwidth BW/Fo for the cylindrical resonator cavity.

DESCRIPTION OF THE PREFERRED EMBODIMENT

Figure 1:
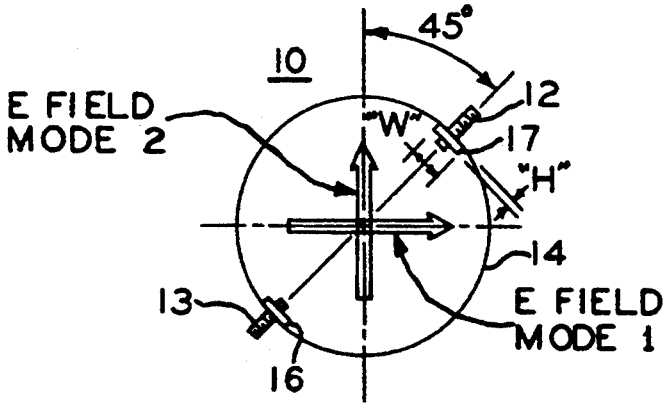
FIG. 1 is a section view of a cylindrical resonator including the coupling bars and fine tuning screws in accordance with a preferred embodiment of the invention.
Figure 2:
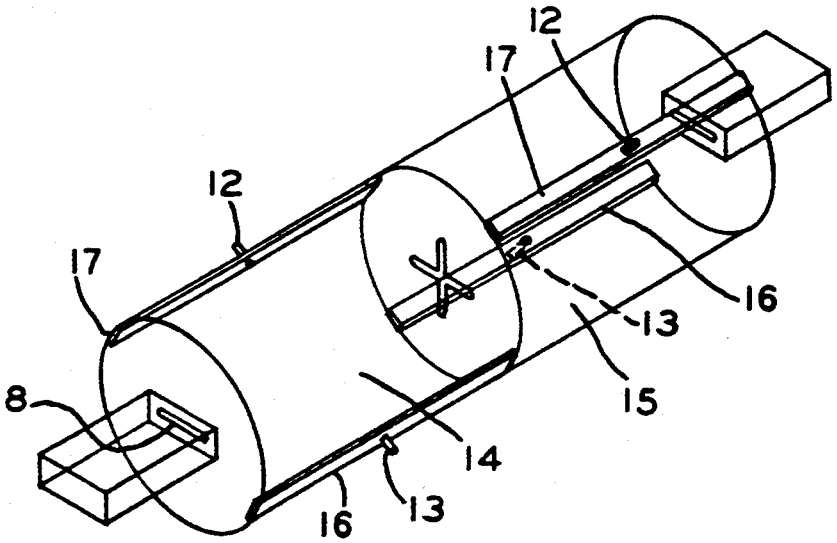
FIG. 2 is an isometric view of two coupled cylindrical resonators of FIG. 1 to obtain a practical filters structure.

Referring now to FIGS. 1 and 2 there is shown a section end view of a cylindrical resonator 10 supporting a TE113 mode electromagnetic wave. Two orthogonal modes, E field mode 1 and E field mode 2 are shown as part of the TE113 propagating wave. There is also shown lying along a common diagonal two tuning screws 12, 13 threaded through the wall 14 of the cylindrical resonator, and through a pair of longitudinal coupling bars 16, 17 which extend over the length of the resonator.

FIG. 2 shows two such cylindrical cavities 14, 15, coupled together to form a practical filter structure. The electromagnetic wave is launched via a slotted coupling 8. Resonator 14 is coupled to a resonator section 15 through conventional coupling slots. Slotted coupling 8 is connected to a source of ku band signals.

The coupling bars 16, 17 and tuning screws 12, 13 are advantageously oriented at 45° to each E field of the TE113 wave propagating in the cylindrical resonator 10. Both the coupling bars 16, 17 and to a lesser extent tuning screws 12, 13 will couple each of the E fields to each other, providing for a Chebyshev four-pole frequency response in the cylindrical resonators 14 and 15.

Figure 3:
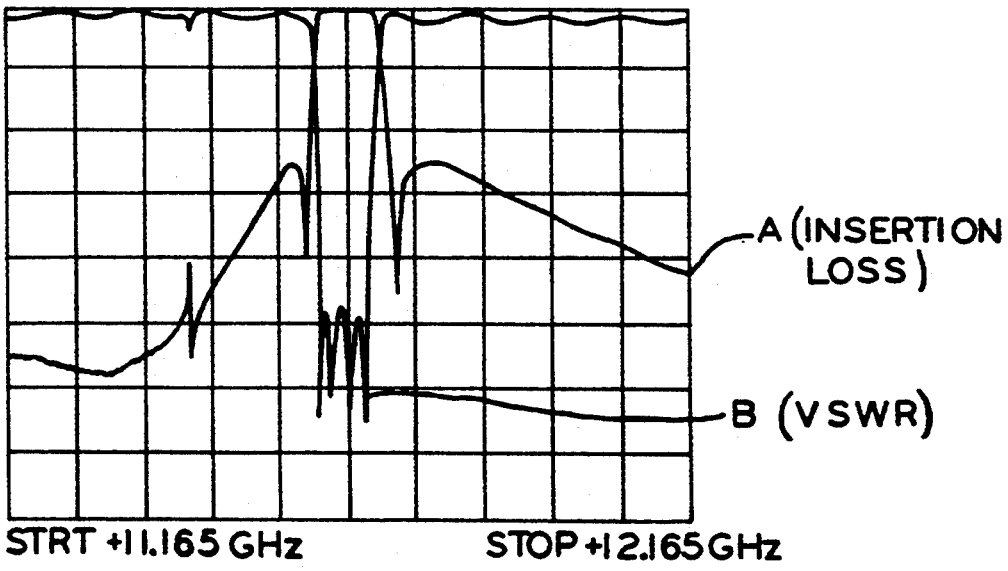
FIG. 3 illustrates the insertion loss and return loss, VSWR response for a quasi-elliptical filter of the cylindrical cavity of FIGS. 1 and 2.

In the preferred embodiment of FIG. 2, coupling bars 16, 17 provide substantially most of the coupling between modes, as will be evident from the description of FIG. 3. As is known in the prior art, tuning screws 12, 13 may themselves be used without coupling bars 16, 17, but, for reasons which will be evident with respect to FIGS. 3 and 4, are not advantageous in providing for a symmetrical passband response at increased passband bandwidths.

FIG. 3 illustrates the response of the device of FIG. 2. The Figure illustrates an insertion loss trace A, as well as a return loss, trace B, i.e., VSWR, for the cylindrical resonator filter structure of FIG. 2. The insertion loss shows the symmetrical side lobe structure outside the passband region, typical of the quasi-elliptical filter realization. The passband region as defined by the equal ripple points is no longer limited to 120 MHz.

Figure 4:
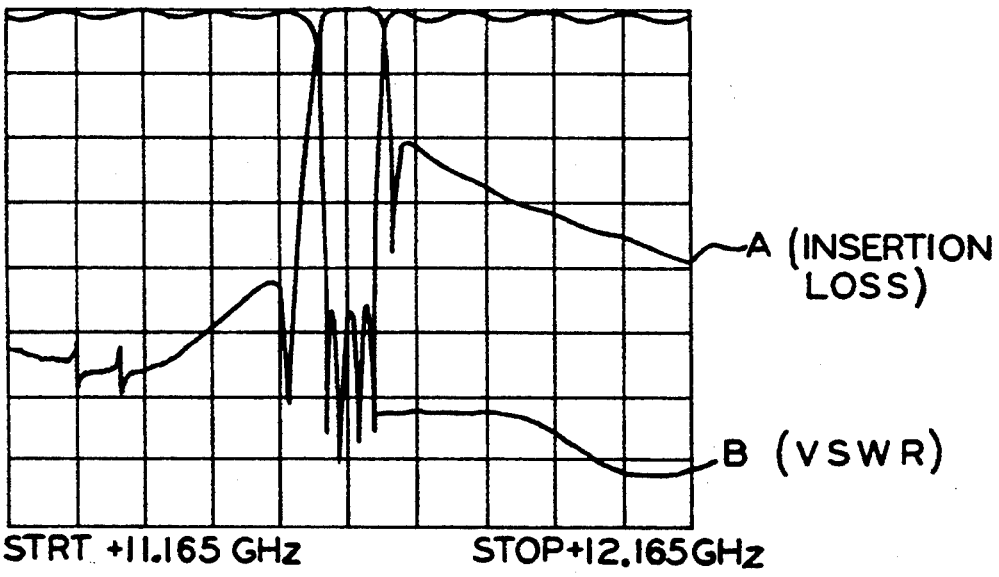
FIG 4 ( PRIOR ART )
FIG. 4 illustrates the return loss and VSWR response for the cylindrical resonators of the prior art for a quasi-elliptical filter, having only tuning screws for coupling orthogonal modes.

In contrast, FIG. 4 shows the non-symmetrical performance of the cylindrical resonator structure of FIG. 2 when there are no coupling bars 16, 17, and coupling is entirely by way of the tuning screws 12 13, as is accomplished in the prior art. The insertion loss trace A illustrates a very non-symmetrical side lobe structure outside the passband region. The loss in stop band attenuation in the region of the upper side lobe is evident.

Figure 5:
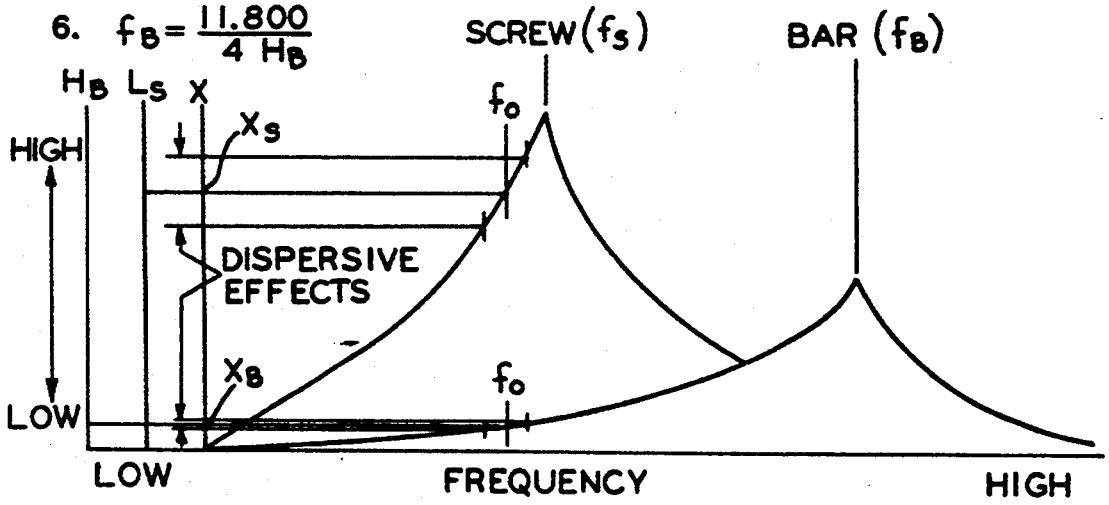
FIG. 5 illustrates the relative symmetry of the frequency response of a cylindrical resonant cavity of the preferred embodiment versus the prior art device.

FIG. 5 illustrates the reactive resonance produced from a prior art Chebyshev quasi-elliptical form filter structures, employing only screws to effect mode coupling versus the present invention inner stage coupling bars. The use of screws will cause an inherently larger reactive resonance X, as shown in FIG. 5. FIG. 5 illustrates that for the same center frequency $f_0$ and same bandwidth, $f_B$ the resonant reactance $X_S$ for the prior art device is much greater than the resonant reactance $X_B$ provided by the present coupling structure.

When the screws of the prior art device penetrate deeper into the microwave filter resonant cavity, it produces a large resonant reactance that shifts downward in frequency and also becomes inherently electrically stronger and more dispersive as this transition takes place. This shift in resonant reactance causes microwave filters and arrays of such filters to have response asymmetries, mode problems, and unwanted low Q resonances which dramatically effect the filter characteristic.

The present invention provides for the lower profile resonant reactance $X_B$. Since, the resonant reactance is smaller, it is less dispersive. As filter designers will recognize, the much lower resonant reactance provides for superior performance.

Given the ability to control the resonant reactance, the present invention is capable of providing filters having a wider bandwidth with greater symmetry. Further, the lower profile of the coupling bar height versus screw length permits the power capability of the filter to be increased, avoiding arcing within the cavity at higher power levels.

As FIG. 5 illustrates, the screw length LS to achieve similar bandwidth results is much greater than the height HB of the coupling bars to obtain the same level of coupling between modes.

Figure 6:
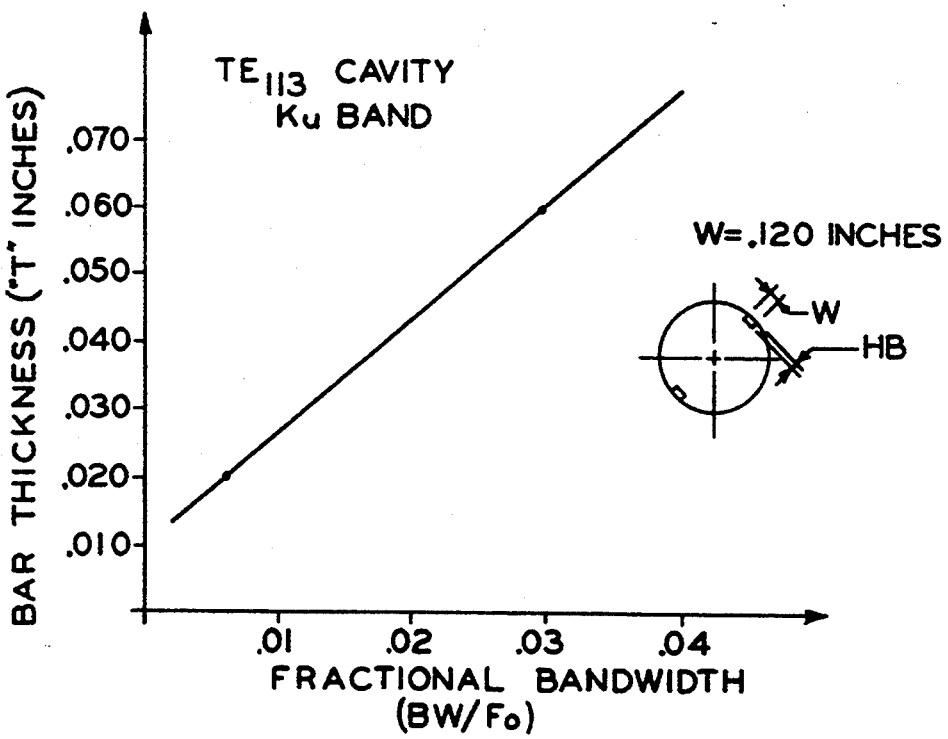
FIG. 6 illustrates the relationship between fractional bandwidth and coupling bar thickness for the TE113 resonant cavity at KU band frequencies.

The relationship between the height HB of each of the coupling bars versus the fractional bandwidth $BW/F_0$ obtainable at KU band is illustrated in FIG. 6. The fractional bandwidth increases with increasing height. It is clear that fractional bandwidths are obtained with a lower profile bar structure, meaning less penetration into the E field than was obtainable with the prior art device which relied solely on tuning screws.

At KU band, the maximum bandwidth achievable is approximately 120 megacycles. The filter response, as illustrated in FIG. 4, was extremely symmetric, utilizing two coupling bars 0.020 inches thick, 0.12 inches wide at the 45° positions. The fine tuning of the coupling was achieved using tuning screws which only minimally penetrated the E field. In the preferred embodiment of the invention, the tuning screws were a pair of 2–56 screws threaded through the wall and coupling bars. As illustrated in FIG. 4, the symmetry was maintained even though waveguide dispersion was still present.

Thus, there has been shown that by using the new coupling structure of the present application for coupling modes in a cylindrical resonator, it is possible to obtain a broader bandwidth while preserving passband symmetry for microwave filter structures, especially in the KU band TE113 mode. Whereas the prior art devices relying solely on tuning screw structures were able to achieve a coupling limited to a passband bandwidth of 1.2%, bandwidths of 4% are obtainable using the coupling structure of the present invention.

The losses accompanying asymmetric filter responses are also avoided due to the preservation of symmetry by the devices. Thus, higher Q filters can be obtained in the cylindrical resonator structure which were previously limited to TEO1 rectangular resonators.

Thus, there has been described with respect to one embodiment, the invention described more particularly by the claims which follow.

What is claimed is:

1. A microwave filter comprising:

a first cylindrical cavity having an input for receiving electromagnetic energy which resonates in a given frequency band and supports first and second orthogonal modes of electromagnetic radiation;

first and second longitudinal bars having a predetermined thickness affixed to an inner wall of said first cavity, opposite each other, lying along a common diameter of said first cavity, said longitudinal bars increasing coupling between said first and second orthogonal modes of electromagnetic radiation, and providing a symmetric filter function about a center frequency having a passband bandwidth proportional to the thickness of said bars;

a second cylindrical cavity axially disposed adjacent the first cylindrical cavity having an input for receiving electromagnetic energy which resonates in a given frequency band and supports first and second orthogonal modes of electromagnetic radiation;

first and second longitudinal bars having a predetermined thickness affixed to an inner wall of said second cavity, opposite each other, lying along a common diameter of said second cavity, said longitudinal bars increasing coupling between said first and second orthogonal modes of electromagnetic radiation, and providing a symmetric filter function about a center frequency having a passband bandwidth proportional to the thickness of said bars; and a coupling slot disposed between the first and second cavities for coupling electromagnetic energy therebetween.

2. The microwave filter of claim 1 further comprising first and second tuning screws extending through said inner wall and coupled to said first and second longitudinal bars, respectively, in each one of said first and second cavities, for adjusting said coupling between said modes.

3. The microwave filter of claim 2 wherein said first and second tuning screws extend through said respective first and second longitudinal bars in each one of said first and second cavities.

4. The microwave filter of claim 1 wherein said bars are located along said common diameter which is disposed substantially 45° with respect to an orientation of said electromagnetic radiation of said first and second modes.

5. The microwave filter of claim 1 wherein each of said cylindrical cavities forms a cylindrical resonator supporting a TE113 mode.

6. The microwave filter of claim 5 wherein said longitudinal bars extend over substantially the entire length of said each cylindrical cavity.

7. A microwave filter comprising:

a first cylindrical cavity resonator coupled to receive an electromagnetic wave having first and second modes of electromagnetic radiation;

first and second longitudinal bars located on an inner wall of said first cylindrical cavity resonator for coupling energy between said first and second modes;

tuning screws inserted through said inner wall of said first cylindrical cavity resonator and coupled to said first and second longitudinal bars for finely adjusting said coupling energy between first and second modes;

a second cylindrical cavity resonator coupled to receive an electromagnetic wave having first and second modes of electromagnetic radiation;

first and second longitudinal bars located on an inner wall of said second cylindrical cavity resonator for coupling energy between said first and second modes;

tuning screws inserted through said inner wall of said second cylindrical cavity resonator and coupled to said first and second longitudinal bars for finely adjusting said coupling energy between first and second modes; and a coupling slot disposed between the first and second cavity resonators for coupling electromagnetic energy therebetween.

8. The microwave filter according to claim 7, wherein said first and second longitudinal bars extend substantially the entire length of said each cylindrical resonator.

9. The microwave filter of claim 7 wherein said first and second longitudinal bars are affixed to said inner wall diametrically opposite each other.

10. The microwave filter of claim 7, wherein said tuning screws extend through said inner wall and through said longitudinal bars.

11. Microwave apparatus comprising:

a cylindrical cavity having an input for receiving electromagnetic energy which resonates in a given frequency band and supports first and second orthogonal modes of electromagnetic radiation; and first and second longitudinal bars having a predetermined thickness affixed to an inner wall of said cavity, opposite each other, lying along a common diameter of said cavity, said longitudinal bars increasing coupling between said first and second orthogonal modes of electromagnetic radiation, and providing a symmetric filter function about a center frequency having a passband bandwidth proportional to the thickness of said bars.

12. The apparatus of claim 11 further comprising first and second tuning screws extending through said cavity wall and coupled to said first and second longitudinal bars, respectively, for adjusting said coupling between said modes.

13. The apparatus of claim 12 wherein said first and second tuning screws extend through said first and second longitudinal bars, respectively.

14. The apparatus of claim 11 wherein said bars are located along said common diameter which is disposed substantially 45° with respect to an orientation of said electromagnetic radiation of said first and second modes.

15. The apparatus of claim 11 wherein said cylindrical cavity forms a cylindrical resonator supporting a TE113 mode.

16. The apparatus of claim 15 wherein said longitudinal bars extend over substantially the entire length of said cylindrical resonator.

* * * * *